US005363790A

United States Patent [19]

Matsuoka

[11] Patent Number: 5,363,790

[45] Date of Patent: Nov. 15, 1994

[54] BUOYANCY COMPENSATOR FOR DIVERS

[75] Inventor: Matsushiro Matsuoka, Hadano, Japan

[73] Assignee: Tabata Co. Ltd., Tokyo, Japan

[21] Appl. No.: 964,016

[22] Filed: Oct. 21, 1992

[30] Foreign Application Priority Data

Oct. 23, 1991 [JP] Japan ..... 3-304125

[51] Int. Cl.[5] ..... B63C 9/02

[52] U.S. Cl. ..... 114/315; 405/186

[58] Field of Search ..... 405/185–187; 114/312, 315, 334; 224/257, 259, 907; 441/106, 108, 113–116, 118, 111; 2/2.1 R

[56] References Cited

U.S. PATENT DOCUMENTS

| | | | |
|---|---|---|---|
| 4,645,465 | 2/1987 | Courtney | 405/186 |
| 4,778,307 | 10/1988 | Faulconer | 405/186 |
| 4,946,313 | 8/1990 | Augurelli | 405/186 |
| 4,952,095 | 8/1990 | Walters | 405/186 |
| 5,011,334 | 4/1991 | Vorhauer | 405/186 |
| 5,074,714 | 12/1991 | Franco | 405/186 |

*Primary Examiner*—Robert J. Oberleitner
*Assistant Examiner*—Clifford T. Bartz

[57] ABSTRACT

A buoyancy compensator that includes an air cylinder holder, a buoyancy compensating bag, a waist belt and a shoulder strap, these components being able to be detachably attached to the air cylinder holder, wherein the waist belt and the shoulder strap can be attached to the air cylinder holder adjustably at desired positions in the height-direction of the air cylinder holder.

5 Claims, 4 Drawing Sheets

BUOYANCY COMPENSATOR FOR DIVERS

BACKGROUND OF THE INVENTION

This invention relates to buoyancy compensators carried by divers for swimming under the surface of water, for example, scuba diving.

Buoyancy compensators are well known as auxiliary means for adjustment of buoyancy equilibrium during activity under the surface of water as well as surfacing in emergency. Such well known buoyancy compensators include the type in which a vest in the form of an air bag is equipped with a harness used to carry an air cylinder on the back of a diver and the type in which there are provided on the shoulders of such vest length-adjustable and detachable shoulder straps. FIGS. 5 and 6 are front and rear perspective views, respectively, exemplarily showing the buoyancy compensator of the latter type. This buoyancy compensator of the prior-art is so constructed that air supply from an air cylinder (not shown) to a vest 3 and exhaust from the vest 3 to the outside thereof may be selectively controlled via an inflation hose 9 or the like. The air cylinder is integrally attached to the vest 3 by means of the harness 10 so that the air cylinder may be carried on the back of a diver as the vest 3 is put on. The harness 10 comprises plastic moldings or semi-hard flexible plate-like material curved so as to fit the externals of the air cylinder and provided with bands 7 and buckles 8 used to hold the air cylinder. Such harness 10 is screw-clamped to or sewed on the back side of the vest 3. The vest 3 is provided along a waist line with belts 4 attached to waist portions 13 which may be fastened to make the waist line of the vest 3 fit around the diver's body. The waist portions 13 are connected to each other with straps 12. Shoulder straps 5, 6 may be adjustably fastened to make it fit about the diver's shoulders.

While such a buoyancy compensator of prior art is convenient in that the waist belt and the shoulder straps may be length-adjusted to make the compensator fit on the diver's body, size-adjustment relying on the waist belt and the shoulder strap has a limitation. Consequently, the buoyancy compensators of disadvantageously various sizes must be produced and stocked to meet the demand. This problem is very serious in view of a trend that the buoyancy compensator and accessories thereof become more and more colorful and the number of items correspondingly increases.

The air cylinder normally weighs ten-odd Kg and therefore the waist belt as well as the shoulder strap must be tightly fastened so as to make the vest fit on a diver's body and thereby to carry the air cylinder tightly on the diver's back. Generally, the vest comprises two sheets of texture placed one on another and air-tightly sealed around the peripheral edge of the sheets thus placed one on another so that both sheets may be inflated in opposite directions. However, with the vest being in close contact with the diver's body, inflation toward the diver's body is necessarily restrained. As a consequence, the buoyancy expected from the specified capacity of the vest can not be obtained and the diver experiences a sense of compression.

While the main components of the buoyancy compensator can be assembled by a series of sewing operations, the buoyancy compensator of the prior art comprising almost all components integrally assembled together becomes bulky as the assembling process proceeds to the second half thereof and productivity reduces due to the troublesome operation of sewing.

SUMMARY OF THE INVENTION

Accordingly, it is a principal object of the invention to solve the above-mentioned problems encountered by the prior art by forming a buoyancy compensator by separately preparing an air cylinder holder, a buoyancy compensating bag including an air bag, a paired shoulder strap, and a waist belt so that the paired shoulder strap and the waist belt can be detachably attached to the holder and the buoyancy compensating bag.

The object set forth above is achieved, in accordance with the invention, by a buoyancy compensator for divers comprising an air cylinder holder, a buoyancy compensating bag including an air bag to which an inflation hose is connectable, a waist belt including length-adjusting means necessary for a diver to carry the holder as well as the buoyancy compensating bag with proper fitness, and right and left paired shoulder strap, characterized in that said holder includes a back pad zone so that said air cylinder may be held by said holder on the outer side of said back pad zone while said buoyancy compensating bag and at least one of the shoulder straps and the waist belt may be attached to said holder on the inner side of said back pad zone with interposition of said buoyancy compensating bag in detachable and height-adjustable fashion; and means for such attachment are provided on said holder, said buoyancy compensating bag and at least one of said shoulder strap and said waist belt.

The invention is preferably executed in the manner as will be described:

(1) The holder comprises sheet-like or meshy member dimensioned and configured to cover the majority of the air cylinder's externals, and bands as well as buckles associated with these bands provided on laterally opposite edges of said holder, respectively, so that each pair of said band and said buckle associated with this band are opposed to each other. These bands and buckles are provided at least adjacent vertically opposite edges of the holder. The outermost edges of the respective bands provided adjacent the vertically opposite edges are spaced from each other by 300 mm or larger.

(2) The means for attachment provided on the holder comprises a dovetail groove longitudinally extending on the inner side of the back pad zone and slide members adapted to be slidably engaged with the dovetail groove. The slide members may be connected to the respective means for attachment associated with the shoulder strap and the waist belt in order to attach at least one of these shoulder strap and waist belt to the holder at desired position or positions in the height-direction of the holder.

(3) The means for attachment provided on the shoulder strap comprises a first coupler plate secured to one end of the shoulder strap, by means of which the shoulder strap is releasably screw-clamped to the means for attachment provided on the holder.

(4) The means for attachment provided on the waist belt comprises a second coupler plate slidably engaged with the waist belt, by means of which the waist belt is releasably screw-clamped to the means for attachment provided on the holder.

(5) The length-adjusting means for the shoulder strap comprises first and second straps longitudinally dividing the shoulder strap into two sections. The first strap is provided on one end with a first buckle by which one end of the second strap is length-adjustably locked while the other end of the first strap is fixed to the first coupler plate and the other end of the second strap is fixed to the waist belt.

(6) The length-adjusting means for the waist belt comprises first and second belts longitudinally dividing the waist belt into two sections. Respective one ends of the first and second belts are connected to each other on the belly side in length-adjustable and detachable fashion while at least one of the other ends is slidably locked by the second coupler plate in length-adjustable fashion.

(7) The buoyancy compensating bag comprises a rear body covering at least the back of a diver and right and left extensions laterally extending from the back pad zone along the waist line. The rear body can be attached together with the first and second coupler plates to the back pad zone of the holder with the rear body interposed between the first and second coupler plate and the back pad zone. The extensions are provided on their inner sides with means by which the extensions are slidably locked on the waist belt longitudinally of the waist belt.

Features of the invention as have been mentioned above allow the buoyancy compensator constructed in accordance therewith to operate in convenient manner as will be described:

(1) The shoulder strap and the waist belt can be detachably and height-adjustably attached to the holder.

(2) One and same buoyancy compensator can be used as of various sizes because both the shoulder strap and the waist belt can be height- and length-adjustably attached to the holder. Such manner of use is not prevented by presence of the buoyancy compensating bag because the latter is separately provided.

(3) The buoyancy compensating bag can be rapidly inflated to provide high buoyancy well in conformity with a specified capacity of the bag, alleviating a sense of oppression otherwise experienced by a diver because inflation of the buoyancy compensation bag is substantially not restrained by the strap and the belt.

(4) The air cylinder can be firmly held on the back of a diver because the air cylinder is held by the sheet-like or meshy holder so that the majority of the cylinder's externals are covered thereby and, more preferably, the outermost edges of the respective belts provided along the vertically opposite edges of the holder are spaced from each other by 300 mm or larger.

(5) An excessive length of the waist belt can be divided into an excess on the belly side and an excess on the back side because the waist belt is longitudinally divided into two sections.

(6) The holder, the buoyancy compensating bag, the shoulder strap and the waist belt may be produced as separate members to complete the buoyancy compensator because these members are adapted to be detachably attached to one another.

BRIEF DESCRIPTION OF THE DRAWINGS

Details of the invention will be readily understood from the following description of the presently preferred embodiment made in reference with the attached drawings, in which.

PREFERRED EMBODIMENT OF THE INVENTION

Figure 1:
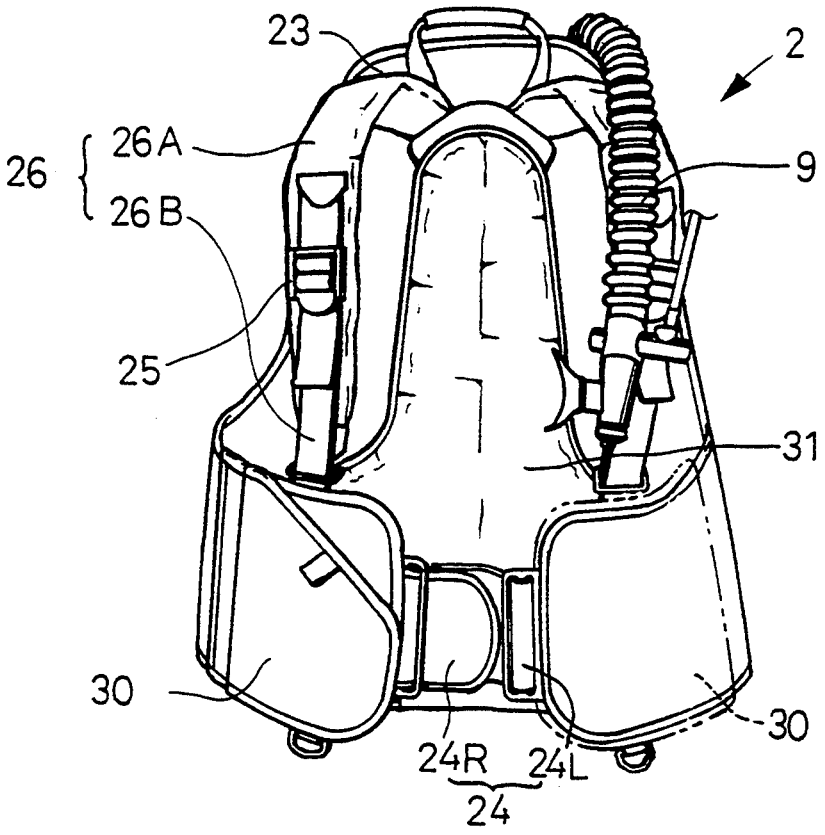
FIG. 1 is a front view of the buoyancy compensator constructed in accordance with the invention.
Figure 2:
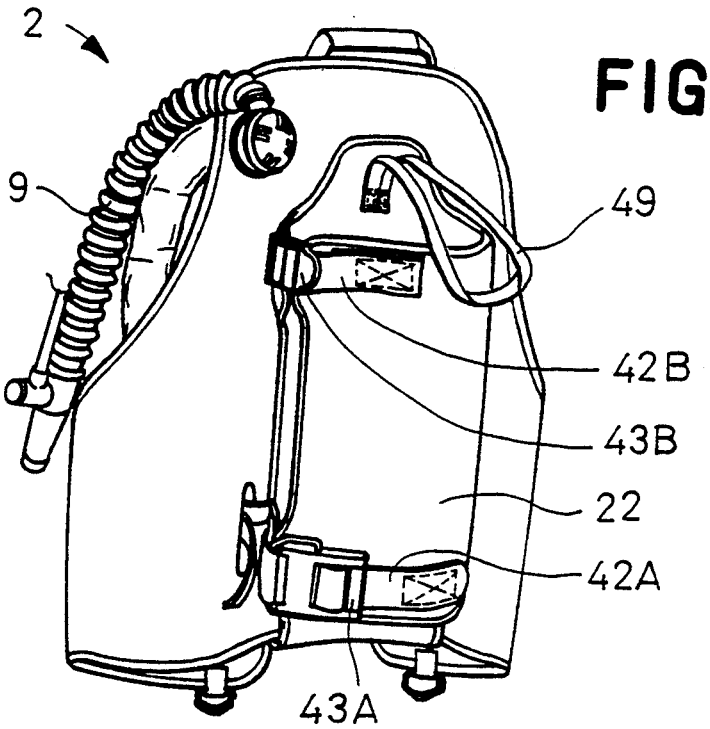
FIG. 2 is a perspective rear view of the buoyancy compensator shown by FIG. 1.

Referring to FIGS. 1 and 2, the buoyancy compensator 2 of the invention is shown in front and rear view, respectively. To facilitate understanding of the construction, a detachable pocket member 30 provided on a left side waist flap is indicated by imaginary line.

The buoyancy compensator 2 of the invention basically comprises, as will be apparent from FIGS. 1 and 2, an air cylinder holder 22, a buoyancy compensating bag 23 provided in the form of an air bag, a shoulder strap 26 consisting of first and second straps 26A, 26B, each being pairly provided, a pair of first buckles 25 adapted for length-adjustably connecting the respective first and second straps 26A, 26B to each other, and a waist belt 24 consisting of first and second belts 24R, 24L. The buoyancy compensator 2 further comprises said detachable pocket member 30 provided on each waist side flap, a cushion pad 31 provided on the rear body and an inflation hose 9 detachably attached to the rear body.

Figure 3:
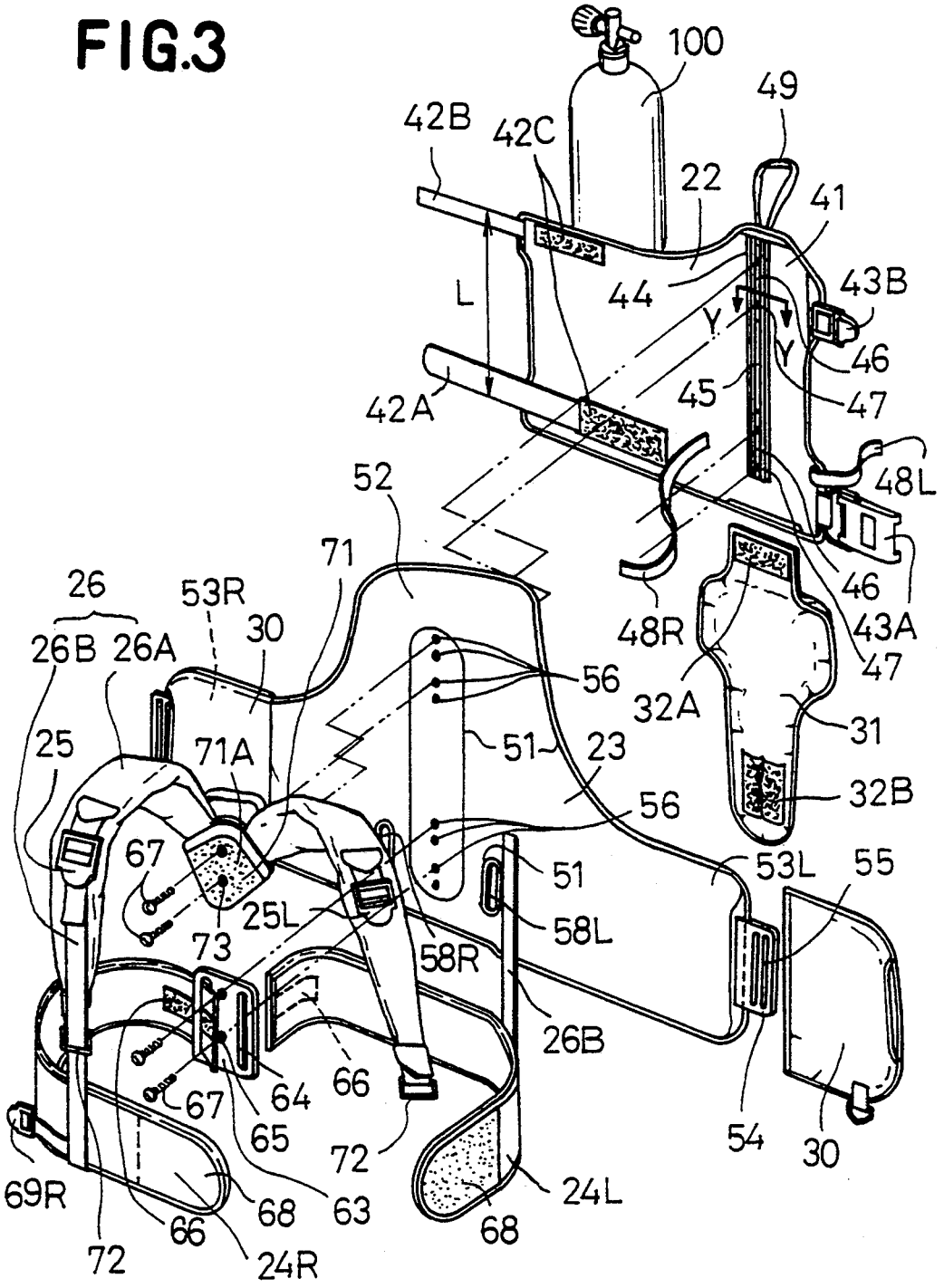
FIG. 3 is an exploded perspective view of the buoyancy compensator shown by FIG. 1.

FIG. 3 is an exploded perspective view of the buoyancy compensator 2, showing the respective components inclusively of the air cylinder 100. Now details of these components as well as the operative relationship thereof will be described.

The holder 22 is made of nylon texture or meshy fabric cut in generally rectangular shape which is horizontally longer except a back pad zone 41 provided as a part of the holder 22. Only over this back pad zone 41 adapted to be directly in contact with the back of a diver, the holder 22 is vertically longer. While the entire width of the holder 22 may be appropriately varied so long as the holder 22 can reliably cover the air cylinder 100, the holder 22 preferably has its width sufficiently large to cover a major portion of the air cylinder's externals. One of the opposite side edges of the holder 22 is provided with a pair of bands 42A, 42B extending in parallel to each other along upper and lower edges, respectively, across the holder 22 beyond the side edge while the other side edge is provided at levels corresponding to the respective bands 42A, 42B with second buckles 43A, 43B adapted to cooperate with the respective bands 42A, 42B to hold the air cylinder 100. It should be understood that the lower band 42A and the lower second buckle 43A are sized wider than the upper belt 42B and the upper second buckle 43B, respectively, so that the air cylinder 100 may be more firmly held around its lower portion than its upper portion. While the height of the holder 22 also may be appropriately dimensioned depending on the length of the air cylinder 100 as measured along its cylindrical portion, the height L measured from the upper edge of the upper band 42B down to the lower edge of the lower band 42A is preferably 300 mm or larger. 12–14 liter air cylinders most commonly used generally have a length of 350–400 mm as measured along their cylindrical portion and a circumference of approximately 580 mm. The holder 22 can hold such air cylinder at two locations respectively adjacent opposite ends. Fasteners 42C are sewed on respective fixed ends of the bands 42A, 42B in order that respective free ends of these bands may be fastened onto the associated fasteners after the air cylinder 100 has been held by the bands 42A, 42B. The back pad zone 41 is provided on the side against which the back of the diver bears with a dovetail groove 45 comprising a vertically flexible plastic frame member 44 and a pair of slide members 46 which are slidable along the dovetail groove 45 and provided with threaded holes 47, respectively, allowing the waist belt 24 and the shoulder strap 26 to be detachably secured to the back pad zone 41. The cushion pad 31 is detachably attached to the lower edge of the back pad zone 41 by means of a fastener 32A which is made of material known by the trademark of Velcro and has been sewed on the cushion pad 31 along its upper edge. The cushion pad 31 is folded upon the back pad zone 41 after the buoyancy compensator 2 has been completely assembled and thus actually utilized in a state as shown by FIG. 1. Adjacent the lower edge of the back pad zone 41, a pair of third belts 48R, 48L are fixedly sewed, at respective one ends, on the holder 22 while the other ends, i.e., the free ends thereof are locked in respective fourth buckles 69R, 69L of the waist belt 24 so that these third belts 48R, 48L may function as safety belts to maintain the holder 22 connected to the waist belt 24. A loop-like strap 49 provided on the holder 22 may be hooked around a valve neck of the air cylinder 100 to prevent the air cylinder 100 from accidentally falling.

Figure 4:
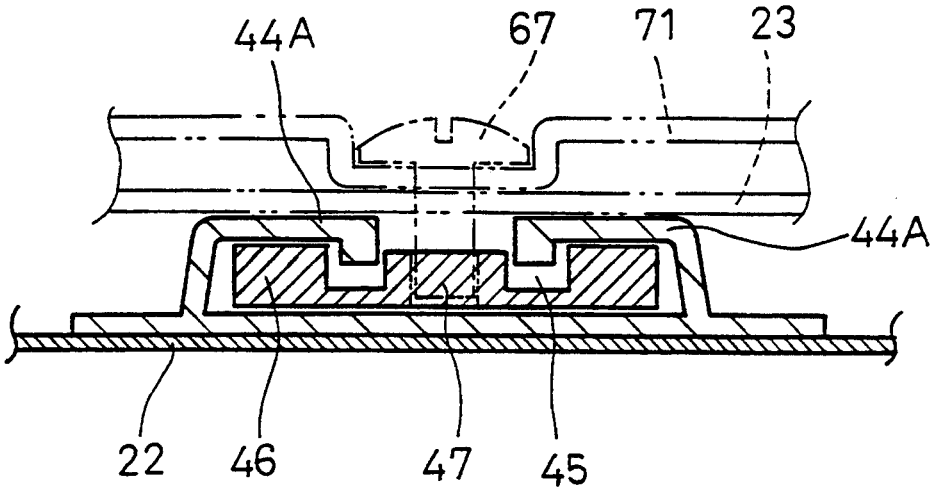
FIG. 4 is a sectional view taken along a line Y—Y in FIG. 3.
Figure 5:
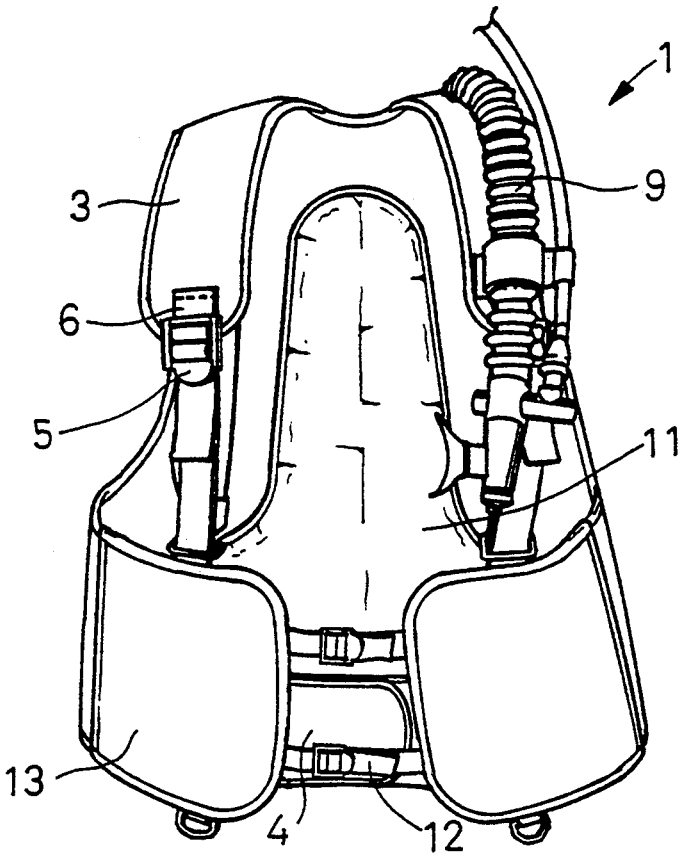
FIG. 5 is a front view exemplarily showing the buoyancy compensator of the prior art.
Figure 6:
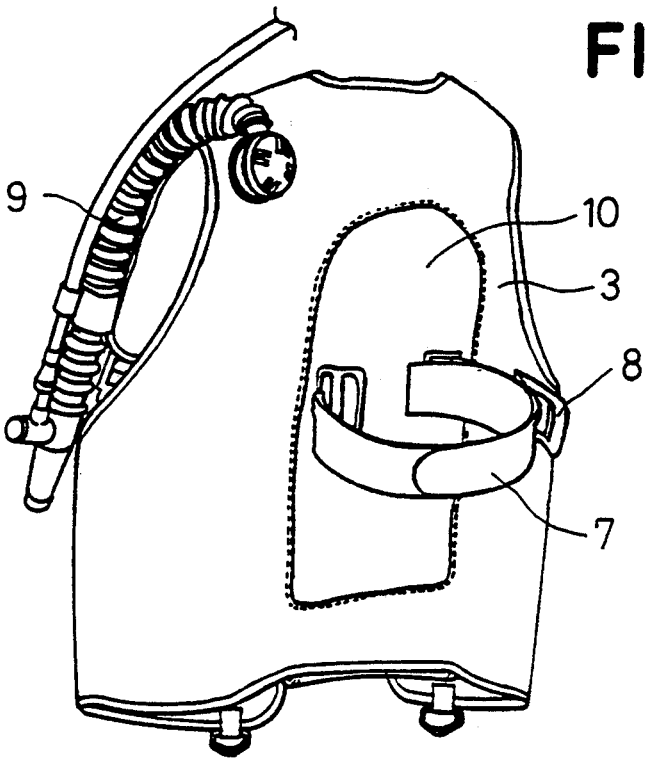
FIG. 6 is a perspective rear view of the buoyancy compensator shown by FIG. 5.

FIG. 4 is a fragmentary sectional view of the holder 22 taken along a line Y—Y in FIG. 3, illustrating details of the dovetail groove 45 together with the buoyancy compensating bag 23 and a first coupler plate 71 of the strap 26 both connected to the dovetail groove 45 and which is indicated by imaginary lines. As previously described, the dovetail groove 45 comprises the flexible plastic frame member 44 sewed on the holder 22, and the first coupler plate 71 of the shoulder strap 26 may be detachably secured, from the outer side of the dovetail groove 45, to the slide member 46 by means of screw bolts 67 to clamp inwardly opposite edges 44A of the frame member 44 in the direction of thickness between the slide members 46 and the first coupler plate 71 and thereby not only to fix the position of the slide members 46 but also to mount the strap 26 at a desired position. It should be understood that the dovetail groove 45 and the slide members 46 may be replaced by other appropriate members provided with a plurality of threaded holes and directly attached to the holder 22.

Referring again to FIG. 3, the buoyancy compensating bag 23 is made of two sheets of air-impermeable nylon texture, each sheet having one side coated with resinous material, placed one over another with their resin-coated sides facing each other and air-tightly sealed by heat-seal lines 51 entirely along the peripheral edge and other locations requiring such air-tight seal. The buoyancy compensator 23 comprises a rear body 52 corresponding to the back of the diver and right and left flap-like extensions 53R, 53L extending from laterally opposite sides of the rear body along the waist line toward right and left, respectively. Plastic buckle-like members 54 having a pair of guide slots 55 are sewed on front ends of the extensions 53R, 53L, respectively, so that the waist belt 24 may be passed through these guide slots 55 and thereby the extensions 53R, 53L may be slidably held by the waist belt 24. The rear body 52 is provided in upper and lower areas with a plurality of through-holes 56, respectively, and screw bolts 67 may be passed through appropriate ones of these through-holes 56 to clamp the waist belt 24 and the shoulder strap 26 to the slide members 46. A sleeve-like pocket member 30 is put on each of the extensions 53R, 53L, if desired, so that the buckle-like member 54 projects out through the side edge of the pocket member 30. The waist belt 24 may be passed through the guide slots 55 of the member 54 thus projecting to hold the pocket member 30 on the associated extension 53R or 53L. The buoyancy compensating bag 23 is further provided adjacent the lower edge thereof with a pair of guide slots 58R, 58L through which the third belts 48R, 48L are passed, respectively.

The waist belt 24 comprises a first belt 24R, a second belt 24L and a second coupler plate 63. The second coupler plate 63 is formed from plastic material in a rectangular shape and provided, in addition to a pair of guide slots 64 extending in parallel to each other, a plurality of through-holes 65 vertically arranged on a line between the guide slots 64. A shown, respective ends of the first and second belts 24R, 24L to be placed on the back of the diver are passed through the guide slots 64 to adjust the length of the respective belts 24R, 24L and then connected to each other by means of fasteners 66 sewed thereon. The second coupler plate 63 is detachably clamped to one of the slide members 46 by means of the screw bolts 67 passed through the through-holes 65 and the through-holes 56 of the buoyancy compensating bag 23. Respective free ends of the first and second belts 24R, 24L to be placed on the belly of the diver are connected to each other also by means of fasteners 68 sewed thereon so that the belt 24 as a whole may well fit around the waist of the diver. The first and second belts 24R, 24L are further provided with third buckles 69R, 69L (the buckle 69L is not seen in FIG. 3) both extending from the belly side toward the back side, and the third belts 48R, 48L of the holder 22 can be connected to these third buckles, respectively.

The shoulder strap 26 basically comprises a pair of the right and left first straps 26A, a pair of the right and left second straps 26B, a first coupler plate 71 made of plastic material on which respective one ends of the first straps 26A are sewed, the first buckles 25 provided adjacent respective free ends of the first straps 26A and to which the second straps 26B are connected, and rings 72 used to guide the second straps 26B. The first coupler plate 71 has plurality of through-holes 73 and can be detachably clamped to one of the slide members 46 by means of the screw bolts 67 passed through these through-holes 73 and the through-holes 56 of the buoyancy compensating bag 23. The ends of the second straps 26B are free ends which are length-adjustably locked by the respective second buckles 25 and the other ends thereof are fixed ends which are sewed on the first and second belts 24R, 24L, respectively. The first coupler plate 71 has a fastener 71A sewed on its side from which the screw bolts 67 are inserted into the through-holes 73.

Though not shown, separately provided nuts may be threaded on the screw bolts 67 projecting out from the through-holes 56 of the buoyancy compensating bag 23 to assure that the diver can reliably carry only the buoyancy compensating bag 23 on the back with use of the waist belt 24 and the shoulder strap 26 neither the holder 22 nor the air cylinder 100 are used. In such case, the buoyancy compensating bag 23 may be provided on the inner side thereof with fasteners cooperating with the fasteners 32A, 32B of the cushion pad 31 and thereby the cushion pad 31 may be attached to the inner side of the buoyancy compensating bag 23.

With the buoyancy compensator 2 of the arrangement as has been described hereabove, the waist belt 24 and the shoulder strap 26 are detachably screw-clamped to the holder 22 at an appropriate level with interposition of the buoyancy compensating bag 23 before the buoyancy compensator 2 is carried on the diver's back, then an effective length of the waist belt 24 is readjusted by adjustably connecting the first and second belts 24R, 24L, on the back side, to each other by means of the respective fasteners 66 sewed on these belts 24R, 24L and, as for the shoulder strap 26, the first and second straps 26A, 26B are length-adjustably locked by the respective first buckles 25 temporarily. The cushion pad 31 is folded inward so as to cover the first and second coupler plates 71, 63 with the associated fastener 32B being pressed against the fastener 71A sewed on the first coupler plate 71. The belly side ends of the first and second belts 24R, 24L are passed through the guide slots 55 of the buckle-like members 54 provided on the respective extensions 53R, 53L, respectively, and thereby these extensions 53R, 53L are slidably supported. Then the buoyancy compensator 2 is equipped with the air cylinder 100. The buoyancy compensator 2 thus equipped with the air cylinder 100 is carried by the diver on the back and the first and second belts 24R, 24L are connected to each other with proper fitness about the belly. Then, the respective free ends of the second strap 26B are pulled so as to adjust fitness of the shoulder strap 26 around the diver's shoulders. In this way, carrying of the buoyancy compensator 2 is completed. The inflation hose 9 is connected to the buoyancy compensating bag 23. Air supply to this buoyancy compensating bag 23 causes the two sheets of texture constituting the bag 23 to be deformed independently of each other and thereby to be inflated in conformity with the specified capacity, since the buoyancy compensating bag 23 is fixed by the screw bolts 67 only at the rear body and the extensions 53R, 53L laterally extending along the waist line are slidable along the waist belt 24. Even when the buoyancy compensating bag 23 is inflated, both the waist belt 24 and the shoulder strap 26 are substantially free from generation of additional tension and the diver experiences no sense of oppression.

The buoyancy compensator constructed according to the invention as has been described hereinabove provides an effect as will be mentioned:

(1) This buoyancy compensator is substantially of the free-size type and can be used over a wide range of sizes because not only the levels at which the waist belt and the shoulder strap are mounted are adjustable but also the these belt and strap are also length-adjustable, and particularly the waist belt is length-adjustable both on the belly side and on the back side.

(2) This buoyancy compensator can be rapidly inflated in conformity with the specified capacity of the buoyancy compensating bag and a correspondingly high buoyancy can be obtained because inflation of the buoyancy compensating bag is not restrained by the waist belt and the shoulder strap.

(3) A diver experience no sense of oppression because such inflated buoyancy compensating bag is not tightly pressed against the diver's body as the case is the conventional buoyancy compensator of vest type.

(4) The holder, the buoyancy compensating bag, the waist belt and the shoulder strap can be independently produced and accordingly the buoyancy compensator can be efficiently produced by avoiding the complicated process of sewing as has been inevitable for the conventional buoyancy compensator, because those components are detachable from one another.

(5) It is unnecessary to stock the products of many sizes because the buoyancy compensator of the invention is substantially of free size type. Additionally, inventory of the buoyancy compensator may be controlled for each component thereof, facilitating trendy, colorful goods to be stocked.

(6) While the invention relates to the buoyancy compensator, the waist belt and the shoulder strap may be clamped directly to the holder by means of the screw bolts to use the buoyancy compensator merely as the air cylinder holder when the buoyancy compensating bag is unnecessary.

What is claimed is:

1. A buoyancy compensator for divers comprising in combination (a) an air cylinder holder (22) having an inner side and an outer side, (b) a buoyancy compensating bag (23) having an air inlet for inflation, (c) a waist belt (24) connected to said buoyancy compensator bag (23), said belt being length adjustable so as to fit said bag (23) about the body of a diver, (d) the outer side of said air cylinder holder (22) including a back pad zone (41) having an inner side and an outer side which is adapted to hold an air cylinder, (e) right and left shoulder straps (26) having upper ends that are both connected to a first coupling member (71) that is separable from both said air cylinder holder (22) and said buoyancy compensating bag (23), (f) height adjustment means (44–47) incorporated in said air cylinder holder (22), said height adjustment means (44–47) including a longitudinally extending dovetail groove (45) on said inner side of said back pad zone (41) and at least one slide member (46) adapted to slidably engage with said dovetail groove (45), and each slide member (46) being adapted to be connected to a connector means (67), and (g) connector means (67) passing through said buoyancy compensating bag (23) and connecting said first coupling member (71) at various levels on said height adjustment means (44–47) and thereby sandwiching said buoyancy compensating bag (23) between said first coupling member (71) and said air cylinder holder (22).

2. A buoyancy compensator according to claim 1 wherein said waist belt (24) contains a second coupling member (63) that is also connectable to said height adjustment means (44–47) by said connector means (67).

3. A buoyancy compensator according to claim 1 wherein said coupling member (71) comprising a plate secured to the upper ends of said shoulder strap (26).

4. A buoyancy compensator according to claim 1 wherein said shoulder straps (26) are length adjustable.

5. A buoyancy compensator according to claim 1 wherein said waist belt (24) comprises a first belt section (24R) and a second belt section (24L) each having inner ends and outer ends, said inner ends being connected to a second coupling member (63) in a length adjustable manner, said outer ends of said first and second belt sections (24R, 24L) being provided with fastening means (68) so that they may be connected to each other in a length adjustable manner.

* * * * *